US009556782B2

(12) United States Patent
Kim

(10) Patent No.: US 9,556,782 B2
(45) Date of Patent: Jan. 31, 2017

(54) HEAT EXCHANGER FOR VEHICLE

(71) Applicant: Hyundai Motor Company, Seoul (KR)

(72) Inventor: Jae Yeon Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 281 days.

(21) Appl. No.: 14/144,484

(22) Filed: Dec. 30, 2013

(65) Prior Publication Data

US 2015/0101781 A1 Apr. 16, 2015

(30) Foreign Application Priority Data

Oct. 14, 2013 (KR) ..... 10-2013-0122234

(51) Int. Cl.
*F28F 27/02* (2006.01)
*F01P 3/12* (2006.01)
*F01P 11/08* (2006.01)

(52) U.S. Cl.
CPC ..... *F01P 3/12* (2013.01); *F01P 11/08* (2013.01); *F28F 27/02* (2013.01); *F01P 2060/045* (2013.01)

(58) Field of Classification Search
CPC ..... F28D 9/0093; F28F 27/02; F16K 31/002; F01P 3/12; F01P 11/08; F01P 7/165; G05D 23/02; G05D 23/1852
USPC ..... 165/140, 153, 103
See application file for complete search history.

(56) References Cited

U.S. PATENT DOCUMENTS 5,964,280 A * 10/1999 Wehrmann ..... F28D 9/005 165/140
6,164,371 A * 12/2000 Bertilsson ..... F28D 9/0093 165/140
6,305,466 B1 * 10/2001 Andersson ..... F28D 9/005 165/140
7,735,520 B2 * 6/2010 Peric ..... F16K 15/144 137/855
9,234,604 B2 * 1/2016 Kim ..... F16K 31/002
2013/0160972 A1 * 6/2013 Sheppard ..... F28F 27/00 165/96

FOREIGN PATENT DOCUMENTS

DE 102004020602 A1 * 12/2005 ..... F28D 9/005
JP 9-32782 A 2/1997
JP 4606786 B2 * 1/2011 ..... F28D 9/0025
JP 2011-69511 A 4/2011
JP 2013-170610 A 9/2013
KR 10-1134974 B1 4/2012

(Continued)

*Primary Examiner* — Tho V Duong
(74) *Attorney, Agent, or Firm* — Morgan, Lewis & Bockius LLP

(57) ABSTRACT

A heat exchanger for a vehicle includes a heat radiating portion provided with first, second and third connecting lines receiving first, second and third operating fluids, respectively, which heat-exchange with each other while passing through the first, second and third connecting lines, a bifurcating portion adapted for one of the operating fluids to bypass the heat radiating portion according to a temperature of the one operating fluid, and a valve unit mounted at an inflow hole forming the bifurcating portion, selectively opening or closing one of the connecting lines, wherein a plurality of inflow holes and a plurality of exhaust holes for the first, second and third operating fluid are formed in the heat radiating portion and the bifurcating portion.

23 Claims, 13 Drawing Sheets

(56) References Cited

FOREIGN PATENT DOCUMENTS

| | | | |
|---|---|---|---|
| KR | 10-2012-0055830 | A | 6/2012 |
| KR | 10-1284337 | B1 | 7/2013 |
| KR | 10-1316858 | B1 | 10/2013 |

* cited by examiner

HEAT EXCHANGER FOR VEHICLE

CROSS-REFERENCE TO RELATED APPLICATION

The present application claims priority of Korean Patent Application Number 10-2013-0122234 filed Oct. 14, 2013, the entire contents of which application is incorporated herein for all purposes by this reference.

BACKGROUND OF INVENTION

Field of Invention

The present invention relates to a heat exchanger for a vehicle. More particularly, the present invention relates to a heat exchanger for a vehicle which can control temperatures of operating fluids which flows in the heat exchanger.

Description of Related Art

Generally, a heat exchanger transfers heat from high-temperature fluid to low-temperature fluid through a heat transfer surface, and is used in a heater, a cooler, an evaporator, and a condenser.

Such a heat exchanger re-uses heat energy or controls a temperature of an operating fluid flowing therein for demanded performance. The heat exchanger is applied to an air conditioning system or a transmission oil cooler of a vehicle, and is mounted at an engine compartment.

Since the heat exchanger is hard to be mounted at the engine compartment with restricted space, studies for the heat exchanger with smaller size, lighter weight, and higher efficiency have been developed.

A conventional heat exchanger controls the temperatures of the operating fluids according to a condition of a vehicle and supplies the operating fluids to an engine, a transmission, or an air conditioning system. For this purpose, bifurcation circuits and valves are mounted on each hydraulic line through which the operating fluids operated as heating medium or cooling medium passes. Therefore, constituent elements and assembling processes increase and layout is complicated.

If additional bifurcation circuits and valves are not used, heat exchanging efficiency cannot be controlled according to flow amount of the operating fluid. Therefore, the temperature of the operating fluid cannot be controlled efficiently.

For warming up or cooling transmission oil and engine oil though heat exchanging, additional heat exchangers are needed to be mounted to an engine, and also additional connecting pipes are required to connecting elements. Thus in a conventional art, manufacturing cost is increased and mounting spaces for the elements are not sufficient.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a heat exchanger for a vehicle having advantages of simultaneously warming up and cooling operating fluids according to temperatures or flow amounts of the operating fluids at a running state or an initial starting condition of the vehicle when the operating fluids are heat exchanged with each other in the heat exchanger.

The present invention has been made in an effort to provide a heat exchanger for a vehicle having further advantages of improving fuel economy and heating performance by controlling temperatures of operating fluids according to condition of the vehicle, and of reducing assembling processes by simplifying a structure of the heat exchanger.

A heat exchanger for a vehicle according to various aspects of the present invention may include a heat radiating portion provided with a first connecting line, a second connecting line and a third connecting line formed alternately by stacking a plurality of plates, and receiving first, second and third operating fluids respectively into the first, second and third connecting lines, the first, second and third operating fluids heat-exchanging with each other during passing through the first, second and third connecting lines and the first, second and third operating fluids supplying into the first, second and third connecting lines not being mixed with each other and being circulated, a bifurcating portion adapted for the one operating fluid of the first, second and third operating fluids to bypass the heat radiating portion according to a temperature of the one operating fluid, and a valve unit mounted at the inflow hole forming the bifurcating portion, selectively opening or closing one of the connecting lines of the heat radiating portion by expansion or contraction of deformable material filled therein so as to flow the operating fluid selectively to the heat radiating portion or the bifurcating portion according to a temperature of the one operating fluid flowing into the inflow hole, wherein a plurality of inflow holes for the first, second and third operating fluids to flow into and a plurality of exhaust holes for the first, second and third operating fluid to flow out may be formed to the heat radiating portion and the bifurcating portion.

The plurality of inflow hole may include a first inflow hole formed to the bifurcating portion, a second inflow hole formed to one side of the heat radiating portion, and a third inflow hole formed to the other side of the heat radiating portion, and the plurality of exhaust hole may include a first exhaust hole formed to the bifurcating portion and communicate with the first inflow hole through the first connecting line, a second exhaust hole formed to the one side of the heat radiating portion and communicate with the second inflow hole through the second connecting line, and a third exhaust hole formed to the other side of the heat radiating portion communicate with the third inflow hole through the third connecting line.

The valve unit may include an outer case including a fixing member which is inserted into the heat radiating portion corresponding to the first inflow hole, of which a mounting groove is formed lower center portion thereof, and fixed to the other side of the heat radiating portion, and an insert portion which is formed to an upper portion of the fixing member integrally, at which at least one first opening is formed along length direction thereof corresponding to the connecting line of the heat radiating portion, and at which at least one bypass hole is formed corresponding to the bifurcating portion, a fixing rod which is inserted into the outer case and of which one end is fixed to the mounting groove of the fixing member, a deformable member which is slidably disposed on the fixing rod, and moves up and down on the fixing rod by the expansion or contraction of the deformable material filled therein according to changing of temperature of the operating fluid, an inner case of which at least one second opening is formed along length direction thereof corresponding to the first opening of the outer case, and which is slidably inserted into the outer case, a flange member which is fixed to the lower portion of the inner case therein, and fixed to the lower portion of the deformable member, a stopper fixedly mounted to the upper portion of the outer case, and an elastic member disposed between the deformable member and the stopper so as to supplying elastic force to the deformable member.

The fixing member of the outer case may be fixed to the heat radiating portion though a snap ring.

The outer case may be a cylinder of which the upper end is opened.

The bypass hole and the first opening may be formed apart from each other along the length direction of the outer case.

The first openings may be formed apart from the bypass hole at the lower portion of the outer case along the length direction of the outer case.

The inner case is a cylinder of which both ends are opened.

The second openings may be formed apart from each other along the length direction of the inner case.

The second openings may be formed misalign along the length direction of the inner case.

The inner case may be moved upward when the deformable member moves upward so that the second opening is positioned at the first opening to open the first opening and close the bypass hole by the inner case.

The inner case may be assembled at the first time as the first opening is closed by the inner case and the second opening is closed by the outer case.

The deformable material filled within the deformable member may be wax material which is expanded or contracted according to the temperature of the operating fluid flowing into the inflow hole.

Flowing holes are formed to the exterior circumference of the flange member.

The exterior circumference of the flange member may be fixed to the lower interior circumference of the inner case, and a mounting portion formed to the center portion of the flange member may be connected to the deformable member and the flange member may be fixed by a fixing ring mounted to the deformable member.

The flange member may be connected to the interior circumference of the inner case.

At least one penetration hole may be formed to the stopper for the operating fluid flowing through the first inflow hole to flow within the valve unit.

The penetration holes may be formed to the center and along circumference of the stopper.

A fixing end may be formed protrude to the stopper for the elastic member to be fixed under the stopper.

A receiving portion, where the stopper is received, may be formed to the upper portion of the outer case.

A ring groove may be formed to the upper and interior circumference of the outer case for a stopper ring to be received thereto for fixing the upper portion of the stopper.

The first inflow hole and the first exhaust hole may be formed to the bifurcating portion in diagonal direction, the second inflow hole and the second exhaust hole may be formed the one side of the heat radiating portion facing diagonally with each other symmetrical to the first inflow hole and the first exhaust hole, and the third inflow hole and the third exhaust hole may be formed the other side of the heat radiating portion facing diagonally with each other symmetrical to the first inflow hole and the first exhaust hole.

One of operating fluids may be a coolant flowing from a radiator, another operating fluid may be a transmission oil flowing from an automatic transmission, and the other operating fluid may be an engine oil from an engine.

The heat radiating portion may be mounted to the automatic transmission, the coolant may flow through the first inflow hole and first exhaust hole, the engine oil may flow through the second inflow hole and second exhaust hole, and the transmission oil may flow through the third inflow hole and the third exhaust hole.

The heat radiating portion may cause the operating fluid to exchange heat with each other by counterflow of the operating fluids.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Throughout the specification and the claims, unless explicitly described to the contrary, the word "comprise" and variations such as "comprises" or "comprising" will be understood to imply the inclusion of stated elements but not the exclusion of any other elements.

In addition, "unit", "means", "part", "member", or the like, which is described in the specification, means a unit of a comprehensive configuration that performs at least one function or operation.

Figure 1:
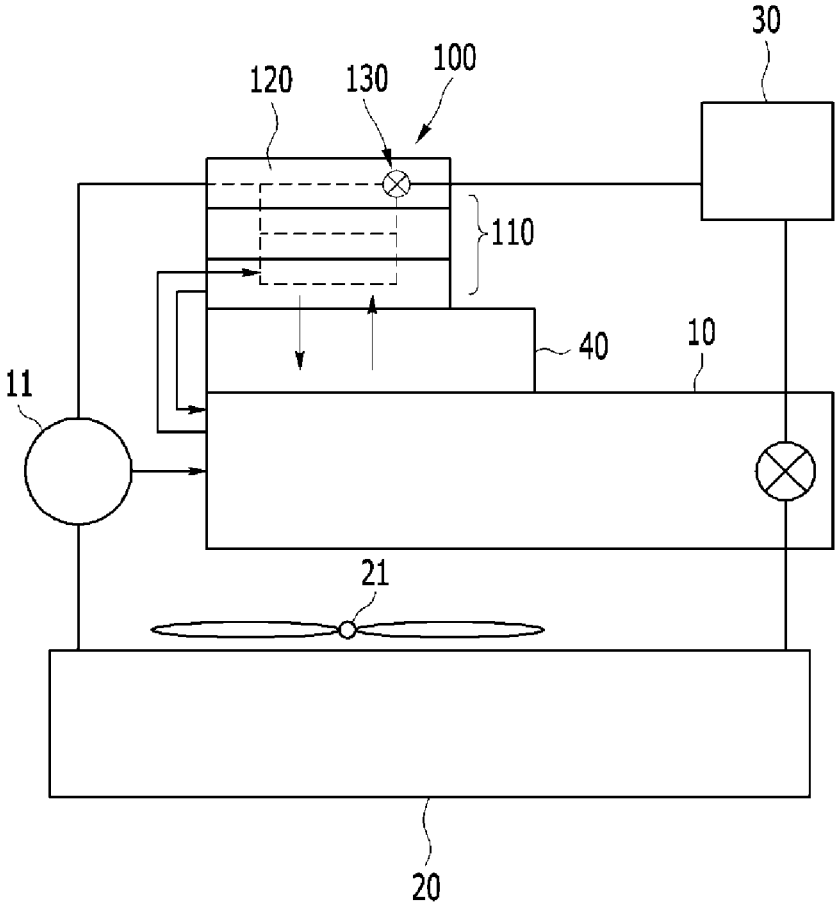
FIG. 1 is a schematic diagram of an exemplary cooling system of an automatic transmission to which a heat exchanger for a vehicle according to the present invention is applied.
Figure 2:
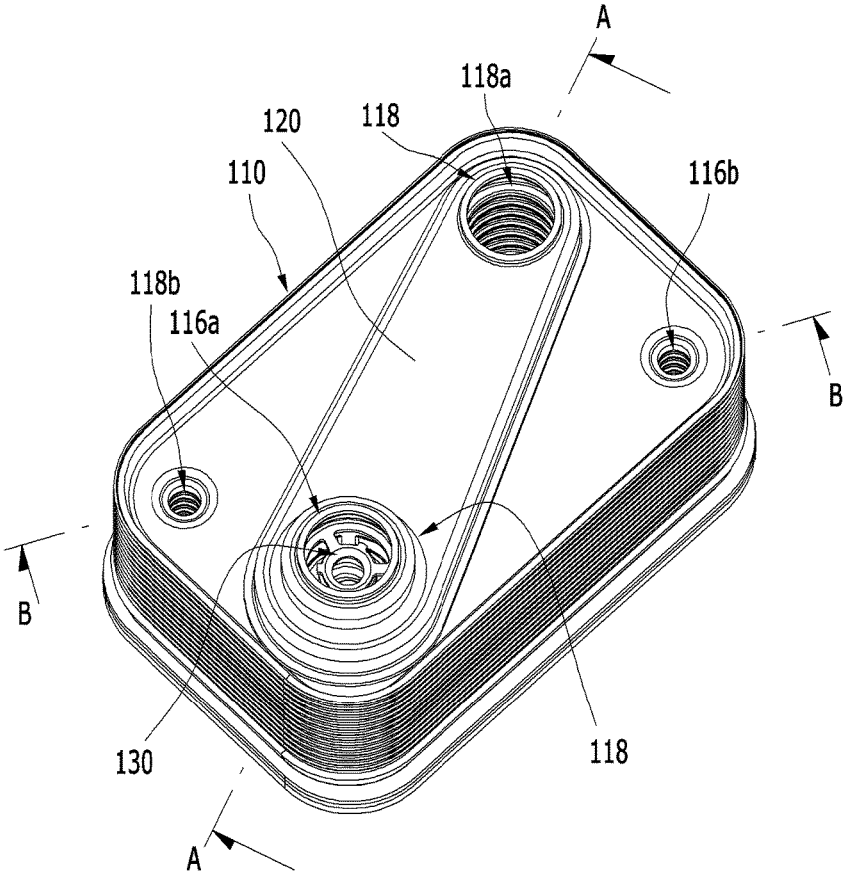
FIG. 2 is a perspective view of an exemplary heat exchanger for a vehicle according to the present invention.
Figure 3:
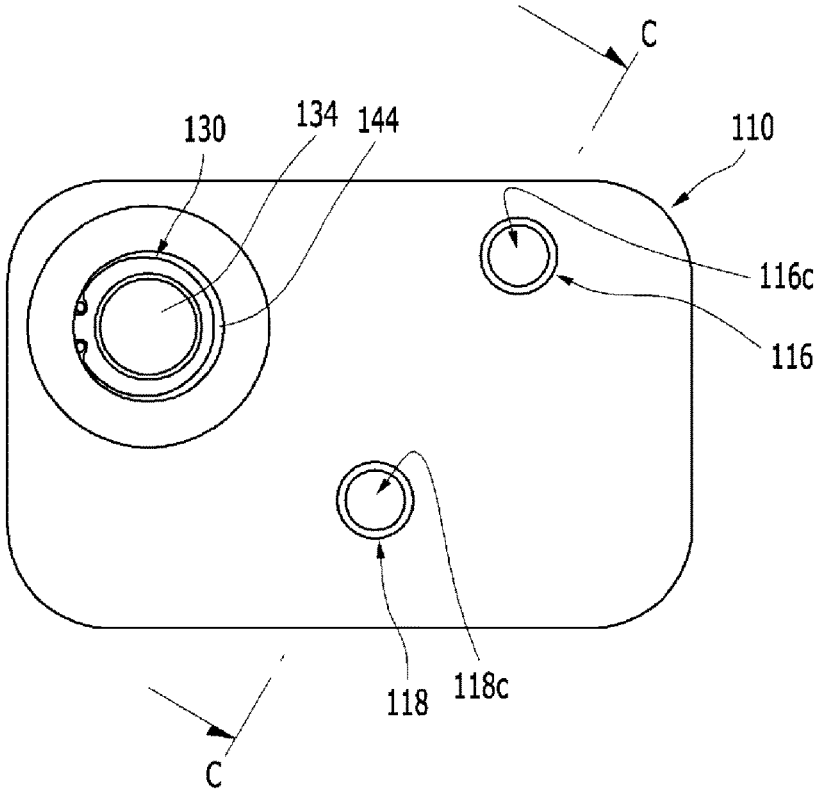
FIG. 3 is a rear view of an exemplary heat exchanger for a vehicle according to the present invention.
Figure 4:
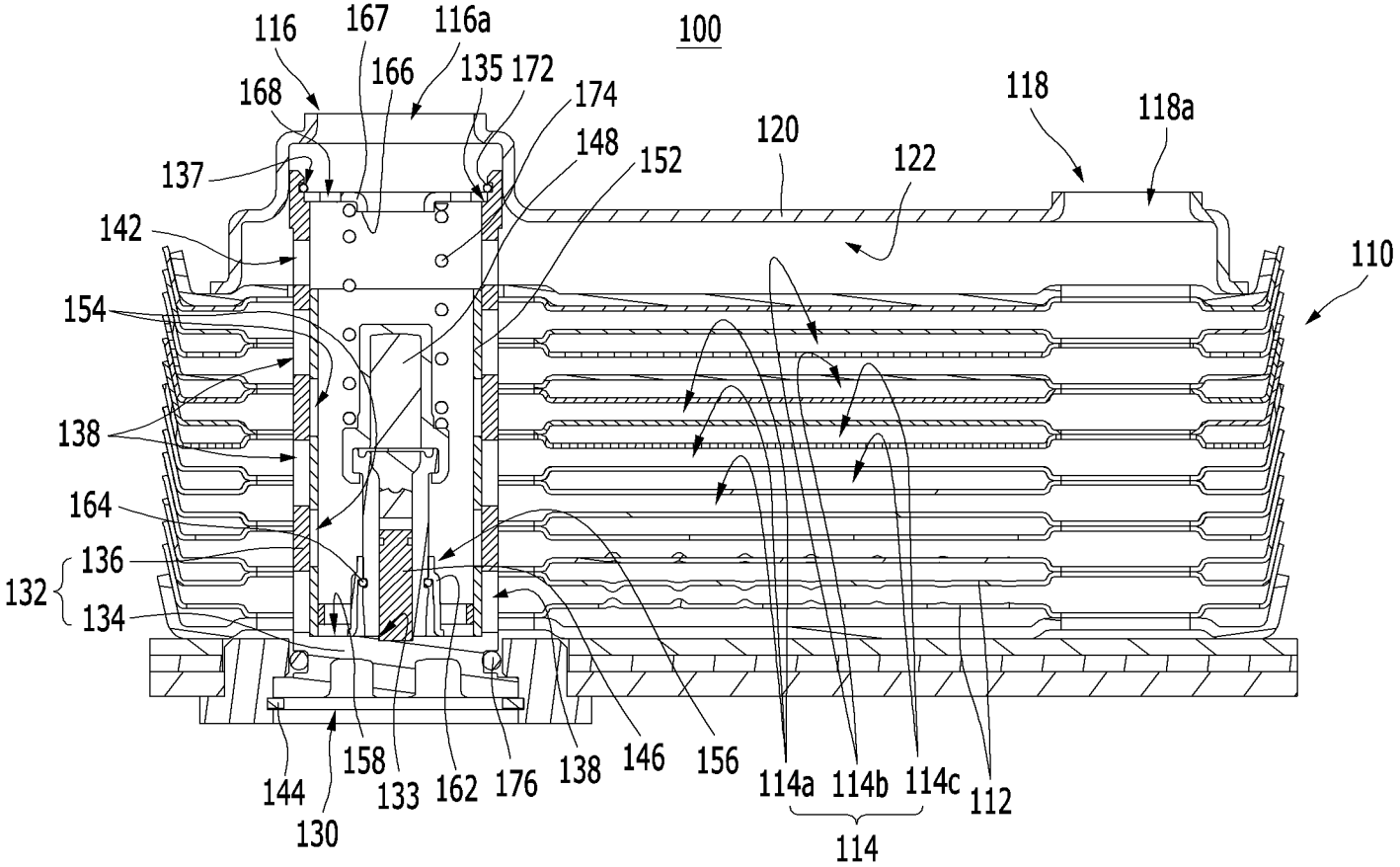
FIG. 4 is a cross-sectional view taken along the line A-A of FIG. 2.
Figure 5:
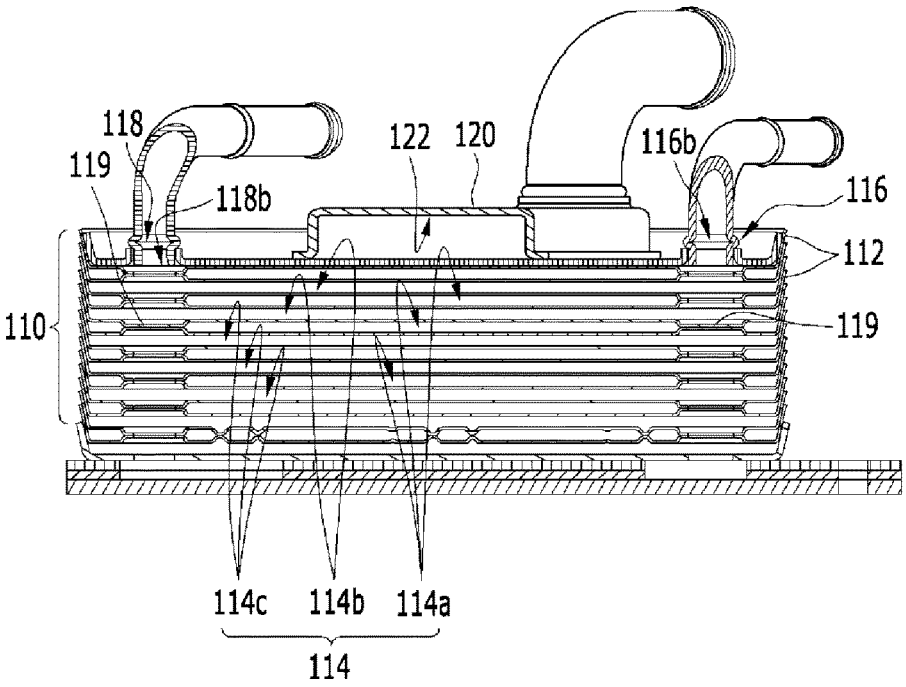
FIG. 5 is a cross-sectional view taken along the line B-B of FIG. 3.
Figure 6:
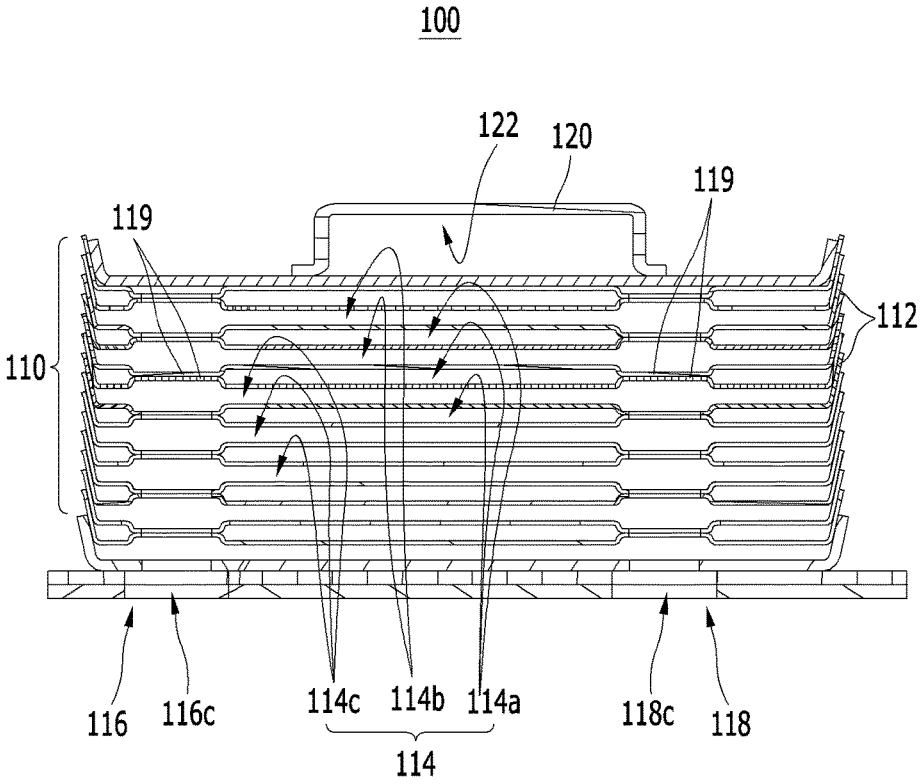
FIG. 6 is a cross-sectional view taken along the line C-C of FIG. 3.
Figure 7:
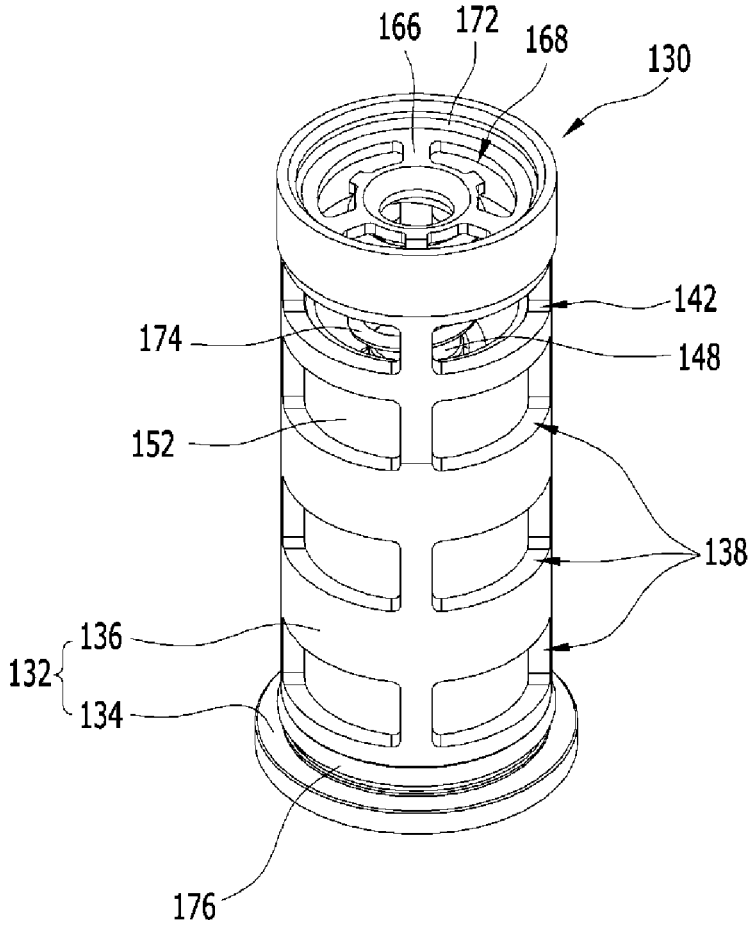
FIG. 7 is a perspective view of a valve unit used in an exemplary heat exchanger for a vehicle according to the present invention.
Figure 8:
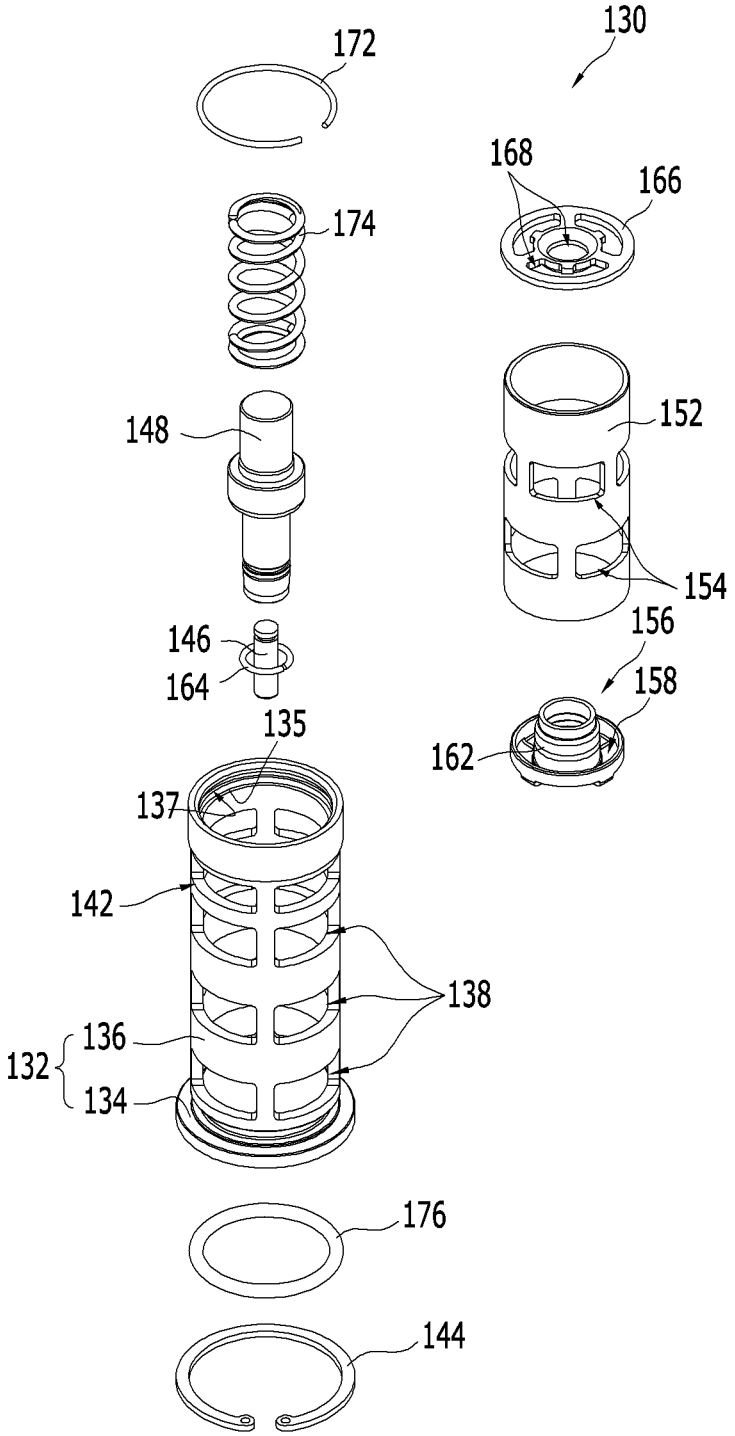
FIG. 8 is an exploded perspective view of a valve unit of FIG. 7 according to the present invention.

FIG. 1 is a schematic diagram of a cooling system of an automatic transmission to which a heat exchanger for a vehicle according to various embodiments of the present invention is applied, and FIG. 2 is a perspective view of a heat exchanger for a vehicle according to various embodiments of the present invention. FIG. 3 is a rear view of a heat exchanger for a vehicle according to various embodiments of the present invention, and FIG. 4 is a cross-sectional view taken along the line A-A of FIG. 2. FIG. 5 is a cross-sectional view taken along the line B-B of FIG. 3, and FIG. 6 is a cross-sectional view taken along the line C-C of FIG. 3. FIG. 7 is a perspective view of a valve unit used in a heat exchanger for a vehicle according to various embodiments of the present invention, and FIG. 8 is an exploded perspective view of a valve unit according to various embodiments of the present invention.

Referring to the drawings, a heat exchanger 100 for a vehicle according to various embodiments of the present invention applies to a cooling system for cooling or warming up of an automatic transmission 40 and an engine 10.

The cooling system, as shown in FIG. 1, is provided with a cooling line for cooling an engine. A coolant passes through the radiator 20 having a cooling fan 21 through a water pump 11 and is cooled by the radiator 20. A heater core 30 connected to a heating system of the vehicle is mounted at the cooling line.

The heat exchanger 100 for a vehicle according to various embodiments of the present invention warms up or cools operating fluids according to temperatures or flow amounts of the operating fluids flowing in at a running state or an initial starting condition of the vehicle when the temperatures of the operating fluids are controlled in the heat exchanger 100 through heat exchange.

The heat exchanger 100 for a vehicle according to various embodiments of the present invention may simplify layout of connecting lines and reduce numbers of elements and manufacturing cost.

In various embodiments of the present invention, the operating fluids include a coolant flowing from the radiator 20, a transmission oil flowing from the automatic transmission 40, and an engine oil flowing from the engine 10. The heat exchanger 100 causes the transmission oil and the engine oil to exchange heat with the coolant such that temperatures of the transmission oil and the engine oil are controlled.

In various embodiments of the present invention, the water pump 11 and the heater core 30 are connected by the coolant pipes, and the coolant circulates. And the heat exchanger 100 is mounted to the automatic transmission 40 for supplying the engine oil and the transmission oil thereto and communicated with the engine 10 and the automatic transmission 40.

The heat exchanger 100 according to the first exemplary embodiment of the present invention, as shown in FIG. 2 and FIG. 3, includes a heat radiating portion 110, a bifurcating portion 120 and a valve unit 130, and each constituent element will be described in detail.

The heat radiating portion 110 is formed by stacking a plurality of plates 112, and a plurality of connecting lines 114 is formed between the neighboring plates 112. The coolant flows through a part of the connecting lines 114 among the plurality of connecting lines 114, the engine oil flows through another part of the connecting lines 114 among the plurality of connecting lines 114, and the transmission oil flows through the other part of the connecting lines 114 among the plurality of connecting lines 114. The operating fluid supplied to the connecting line 114 is not mixed with other operating fluid supplied to other connecting line 114.

The engine oil, the transmission oil and the coolant flow through the connecting lines 114 of the heat radiating portion 110 and exchange heat each other. And at least one inflow hole 116 and exhaust hole 118 are formed to one side (an upper portion) and the other side (a lower portion) of the heat radiating portion 110 and are communicated with the each connecting line 114.

Herein, the heat radiating portion 110 causes the coolant to exchange heat with the transmission oil and the engine oil by counterflow of the coolant and the transmission oil and the engine oil.

The heat radiating portion 110 is a heat radiating portion of plate type (or disk type) where the plurality of plates 112 is stacked.

The bifurcating portion 120 connects one of inflow holes 116 for flowing the operating fluids into the heat radiating portion 110 with one of exhaust holes 118 for discharging the operating fluids from the heat radiating portion 110.

The bifurcating portion 120 is protruded from the heat radiating portion 110 for the operating fluid to detour and a bypass line 122 is formed within the bifurcating portion 120.

In the present exemplary embodiment, the inflow hole 116 includes first and second inflow holes 116*a* and 116*b* formed to one side (the upper portion) of the heat radiating portion 110 and a third inflow hole 116*c* diagonally with the first inflow hole 116*a* formed to the other side (the lower portion) of the heat radiating portion 110.

The exhaust hole 118 includes first and second exhaust holes 118*a* and 118*c* formed to the upper side of the heat radiating portion 110 corresponding to the first and second inflow holes 116*a* and 116*b* and apart from the first and second inflow holes 116*a* and 116*b*, and a third exhaust hole 118*c* formed to the lower portion of the heat radiating portion 110 corresponding to the third inflow hole 116*c* apart from the third inflow hole 116*c*.

The first, second and third inflow holes 116*a*, 116*b*, and 116*c* are communicated with the first, second and third exhaust holes 118*a*, 118*b*, and 118*c* through each connecting line 114 within the heat radiating portion 110 respectively.

The first inflow hole 116*a* and the first exhaust hole 118*a* are formed at corner portions of the upper portion of the heat radiating portion 110 diagonally. That is, the first inflow hole 116*a* and the first exhaust hole 118*a* are formed to the bifurcating portion 120.

The second inflow hole 116*b* and the second exhaust hole 118*b* are formed at corner portions of the upper portion of the heat radiating portion 110 facing diagonally with each other symmetrical to the first inflow hole 116*a* and the first exhaust hole 118*a*.

The third inflow hole 116*c* and the third exhaust hole 118*c* are foamed at corner portions of the lower portion of the heat radiating portion 110 facing diagonally with each other symmetrical to the first inflow hole 116*a* and the first exhaust hole 118*a*.

The heat radiating portion 110 is mounted to the automatic transmission 40 through the lower portion (the other side) thereof, and the coolant circulates through the first inflow hole 116*a* and first exhaust hole 118*a*. The engine oil circulates through the second inflow hole 116*b* and the second exhaust hole 118*c* connected with the engine 10 and the transmission oil circulates through the third inflow hole 116*c* and the third exhaust hole 118*c*.

Connecting ports may be mounted respectively at the first and second inflow holes 116*a* and 116*b* and the first and second exhaust holes 118*a* and 118*b*, and are connected to the radiator 20 and the engine 10 through connecting hoses connected to the connecting ports.

According to the present exemplary embodiment, the connecting line 114, as shown in FIG. 4 and FIG. 5, includes first, second and third connecting lines 114*a*, 1147*b* and 114*c*.

At the first connecting line 114*a*, the coolant flowing through the first inflow hole 116*a* circulates.

At the second connecting line 114*b* and the third connecting line 114*c*, the engine oil and the transmission oil flowing through the second inflow hole 16*b* and third inflow hole 116*c* respectively circulate respectively.

In the present exemplary embodiment, although it is described as the coolant inflowing through the first inflow hole 116*a* and the first exhaust hole 118*a* flows through the first connecting line 114*a*, and selectively operates the valve unit 130, and the engine oil inflowing through the second inflow hole 116*b* and the second exhaust hole 118*b* flows through the second connecting line 114*b*, and the transmission oil inflowing through the third inflow hole 116*c* and the third exhaust hole 118*c* flows through the third connecting line 114*c*, however it is not limited thereto. On the contrary, the coolant, the engine oil and the transmission oil may be replaced each other.

In addition, the valve unit 130 is mounted at the heat radiating portion 110 corresponding to the first inflow hole 116*a* forming the bifurcating portion 120, and flows the coolant to the heat radiating portion 110 or to the bypass line 122 according to the temperature of the coolant.

The valve unit 130, as shown in FIG. 7 and FIG. 8, includes an outer case 132, a fixing rod 146, a deformable member 148, an inner case 152, a flange member 156, a stopper 166 and an elastic member 174, and will be described in detail.

The outer case 132 is inserted into the heat radiating portion 110 corresponding to the first inflow hole 116*a*.

The outer case 132 includes a fixing member 134 of which a mounting groove 133 is formed lower center portion thereof, is fixed to the other side (the lower portion) of the heat radiating portion 110, and an insert portion 136 that is formed to an upper portion of the fixing member 134 integrally. One will appreciate that such integral components may be monolithically formed.

The insert portion 136 is shaped as a cylinder shape, a plurality of the first opening 138 is formed to exterior circumference of the insert portion 136 corresponding to the first connecting line 114*a* of the heat radiating portion 110, and at least at least one bypass hole 142 is formed to exterior circumference of the insert portion 136 corresponding to the bypass line 122 of the bifurcating portion 120.

The bypass holes 142 and the first openings 138 are formed apart from each other along the length direction of the outer case 132 with a predetermined angle. In the present exemplary embodiment, 4 bypass holes 142 and first openings 138 are formed with 90° from adjacent the bypass holes 142 or the first openings 138 along the exterior circumference of the insert portion 136, but is not limited thereto.

The first openings 138 are formed apart under the bypass holes 142 and along the length direction of the outer case 132.

The fixing member 134 of the outer case 132 is fixed to the heat radiating portion 110 though a snap ring 144 that is mounted at the other surface of the heat radiating portion 110.

The outer case 132 is a cylinder of which the upper end is opened.

In the present exemplary embodiment, the fixing rod 146 is inserted into the outer case 132, and a lower end of which is fixedly mounted to the mounting groove 133 of the fixing member 134.

The fixing rod 146 is mounted vertically to the mounting groove 133 of the fixing member 134 with the fixing member 134.

The deformable member 148 is connected to an upper portion of the fixing rod 146, the position of the deformable member 148 is changed up and down on the fixing rod 146 according to expansion or contraction of the deformable material filled within the deformable member 148 affected by the temperature of the operating fluid.

The deformable material may be a wax material that is expandable and contractable according to the temperature of the operating fluid.

The wax material or wax element is a thermal expansion material according to the temperature.

The deformable member 148 is an assembly filled with the wax material. When the volume of the wax material is changed according to the temperature, the deformable member 148 is moved up or down on the fixing rod 146 without changing of the appearance.

If the coolant with relatively high temperature flows through the first inlet 116*a*, the deformable member 148, by the expansion of the wax material filled therein, moves upward on the fixing rod 146.

On the contrary, if the coolant with relatively low temperature flows through the first inlet 116*a*, the deformable member 148, by the contraction of the wax material filled therein, moves downward on the fixing rod 146.

If the coolant with relatively low temperature flows through the first inlet 116*a* when the deformable member 148 positions at initial state, the deformable member is not moved up or downward because the volume of the wax material is not changed.

In the present exemplary embodiment, at least one second opening 154 is formed to the inner case 152 along the length direction thereof corresponding to the first opening 138 of the outer case 132, and the inner case 152 is slidable within the outer case 132.

The inner case 152 is a cylinder shape of which both ends are opened.

The second openings 154 are formed misalign along the length direction of the inner case 152 corresponding to the first opening 138 with a predetermined angle from each other.

In the drawings, 4 second openings 154 are formed to an upper and lower portion of the exterior circumference of the inner case 152 with 90° from adjacent the second openings 154, but is not limited thereto.

In the present exemplary embodiment, the flange member 156 is connected to the interior circumference of the inner case 152, and a center of which is fixed to the lower portion of the deformable member 148.

The flange member 156 may be integrally formed with the inner case 152, is slidable within the outer case 132, and is fixed to the lower portion of the deformable member 148. One will appreciate that such integral components may be monolithically formed.

Flowing holes 158 may be formed to the exterior circumference of the flange member 156 with a predetermined angle.

For example, 4 flowing holes 158 may be formed to the exterior circumference of the flange member 156 with 90°, and the operation fluid flowing through the first inflow hole 116*a* may flow to the first connecting line 114*a* of the heat radiating portion 110 via the inner side of the inner case 152, the flowing hole 158 and the second opening 154.

The exterior circumference of the flange member 156 is fixed to the interior circumference of the inner case 152, and the mounting portion 162 formed to the center thereof is fixed to the deformable member 148 through the fixing ring 164.

In the present exemplary embodiment, the inner case 152 moves upward with deformable member 148 within the outer case 132 by the flange member 156 when the deformable member 148 moves upward.

In this case, the second openings 154 of the inner case 152 is positioned corresponding to the first openings 138 so as to open the first openings 138 and the upper portion of the inner case 152 closes the bypass hole 142.

The inner case 152 may be assembled at the first time as the second opening 154 is closed by a closed section between the first openings 138 and thus the first openings 138 are closed, and the upper portion of the inner case 152 is positioned under the bypass hole 142 so as to open the bypass hole 142.

In the present exemplary embodiment, the stopper 166 is fixed to the upper end of the outer case 132.

At least one penetration hole 168 is formed to the stopper 166 for the operating fluid flowing through the first inflow hole 116*a* to flow within the valve unit 130 to be supplied to the deformable member 148.

In the drawings, the penetration holes 168 are formed to the center of the stopper 166 and 4 penetration holes 168 are formed along circumferential direction with 90° but, it is not limited thereto.

A receiving portion 135, where the stopper 166 is received, is formed to the upper portion of the outer case 132.

The receiving portion 135 is formed along the interior circumference of the outer case 132 and protrudes toward the center of the outer case 132.

A ring groove 137 is formed to the upper and interior circumference of the outer case 132 for a stopper ring 172 to be received thereto for fixing the upper portion of the stopper 166.

The stopper 166 is disposed to the receiving portion 135 of the outer case 132 and is fixed by the stopper ring 172 mounted to the ring groove 137.

The elastic member 174 is interposed between the deformable member 148 and the stopper 166 and supplies elastic force to the deformable member 148.

One end of the elastic member 174 is supported by the stopper 166 and the other end thereof is supported by the deformable member 148 and the elastic member 174 may be a coil spring.

Thus, the elastic member 174 is compressed when the deformable member 148 moves upward on the fixing rod 146.

On the contrary, when the deformable member 148 moves downward, the elastic member 174 supplies elastic force to the deformable member 148 so as for the deformable member 148 rapidly returns to the original position.

A fixing end 167 is formed protrude to the stopper 166 for the elastic member 174 to be fixed under the stopper 166.

The fixing end 167 supports the elastic member 174 stably.

In the drawings, each four first and second openings 138 and 154, bypass holes 142, flowing holes 158 and penetration holes 168 are formed with 90° along circumferential direction. However it is not limited thereto, on the contrary, positions and numbers of each opening 138 and 154, bypass hole 142, flowing hole 158 and penetration hole 168 may be various.

A seal ring 176 may be disposed between the heat radiating portion 110 and the fixing member 134 of the outer case 132 for the operating fluid, for example the coolant, flowed within the valve unit 130 not to be leaked out except for the openings 138 and 154 and the bypass holes 142 of the valve unit 130, and also not to be leaked out between the heat radiating portion 110 and the fixing member 134.

Figure 9:
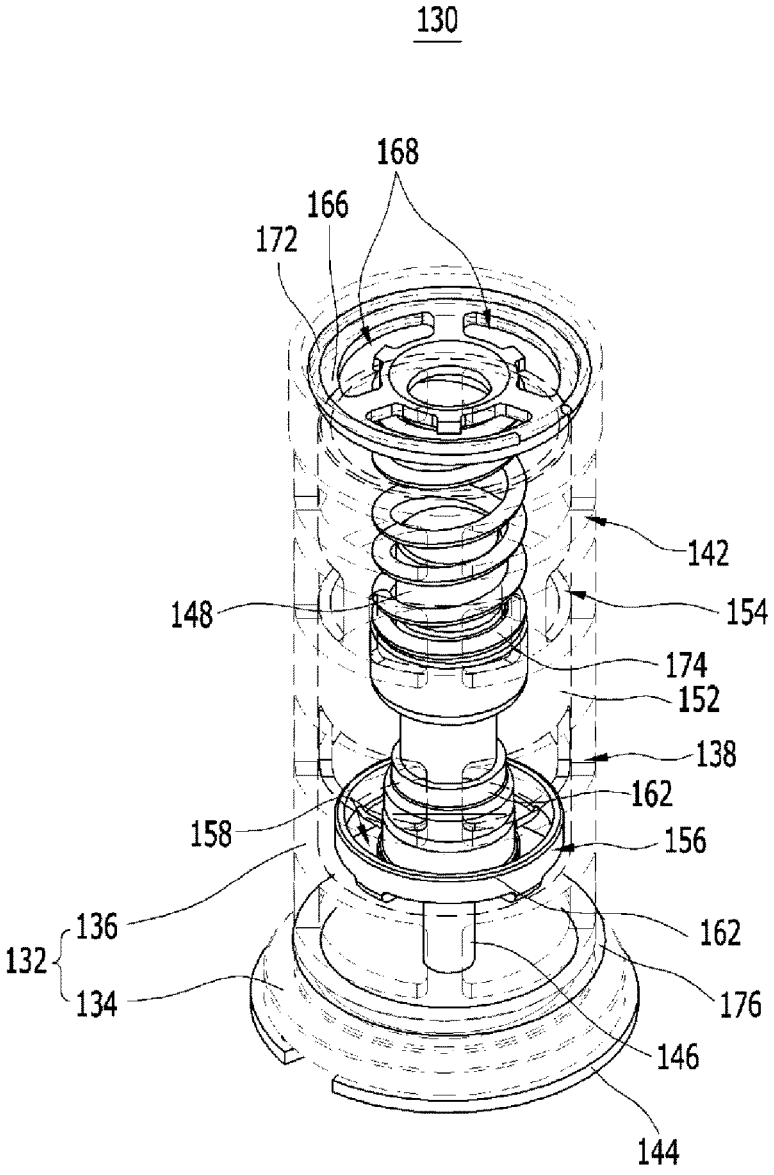
FIG. 9 is a drawing for describing operation of a valve unit for an exemplary heat exchanger according to the present invention.

FIG. 9 is a drawing for describing operation of a valve unit for a heat exchanger according to various embodiments of the present invention.

As shown in FIG. 9, the operating fluid with high temperature flows through the first inflow hole 116*a* and the penetration holes 168 of the stopper 166 and into the inside of the outer case 132 and the inner case 152.

Then, the deformable member 148 moves upward on the fixing rod 146 by the expansion of the wax material within the deformable member 148.

Thus, the flange member 156 fixed to the lower portion of the deformable member 148 moves upward together with the deformable member 148. Simultaneously, the inner case 152 slides upward with the flange member 156 within the outer case 132.

In this case, the elastic member 174 is compressed and simultaneously, the bypass hole 142 is closed by the inner case 152.

The second openings 154 are positioned corresponding to the first openings 138 so as to be opened, thus the coolant flows through the first connecting line 114*a*.

If the operating fluid with temperature below a predetermined temperature flows into the first inflow hole 116*a*, the deformable member 148 moves downward on the fixing rod 146.

In this case, the elastic member 174 supplies elastic force to the deformable member 148 so as for the deformable member 148 rapidly to return to the original position.

Then the inner case 152 moves downward together with the flange member 156 fixed to the deformable member 148, and thus the bypass holes 142 are opened and simultaneously the first openings 138 are closed.

Hereinafter, functions and operations of the heat exchanger 100 according to various embodiments of the present invention will be described.

FIG. 10 to FIG. 13 are drawings for describing operation of a heat exchanger for a vehicle according to various embodiments of the present invention.

Figure 10:
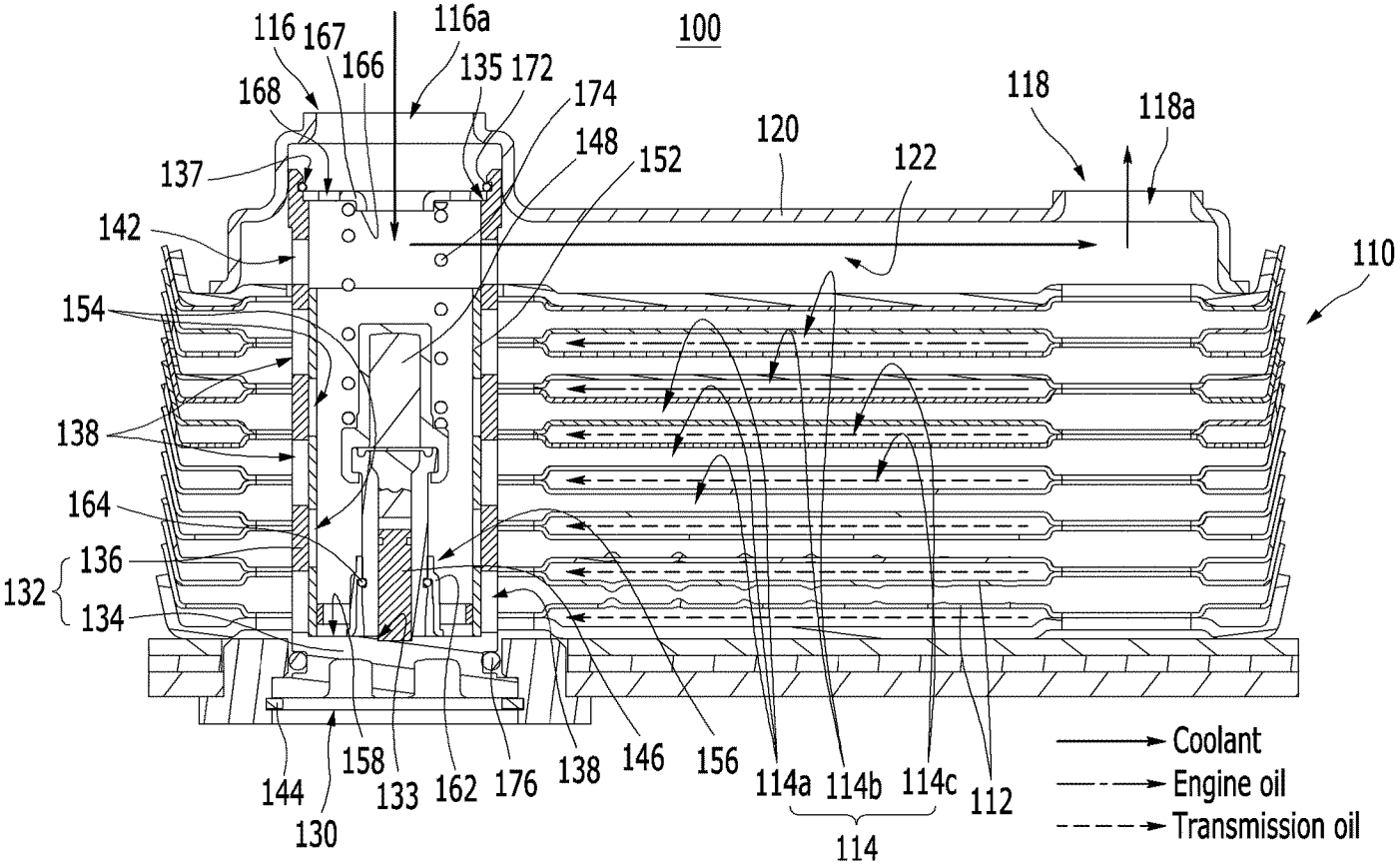
FIG. 10, FIG. 11, FIG. 12, and FIG. 13 are drawings for describing operation of an exemplary heat exchanger for a vehicle according to the present invention.

If the temperature of the coolant flowing into the first inflow hole 116*a* is lower than a predetermined temperature, as shown in FIG. 10, the deformable member 148 maintains the initial position.

Thus the inner case 152 also maintains the initial position (referring to FIG. 7), and the bypass hole 142 of the outer case 132 is opened.

As described above, the first opening 138 and the second opening 154 are closed by the inner case 152 and the outer case 132 respectively.

Thus, the coolant flowing into the valve unit 130 is prevented from flowing into the first connecting line 114*a*.

The coolant flows from the valve unit 130 through the bypass hole 142 and the bypass line 122 formed by the bifurcating portion 120, and flows out through the first exhaust hole 118*a*.

Accordingly, the coolant does not flow into the first connecting line 114*a* of the heat radiating portion 110. So the coolant does not exchange heat with the engine oil flowed through the second inflow hole 116*b* and the second connecting line 114*b* of the heat radiating portion 110, and the transmission oil flowed through the third inflow hole 116*c* and the third connecting line 114*c* of the heat radiating portion 110.

If the transmission oil and the engine oil should be warmed up according to a condition or a mode of the vehicle such as a running state, an idle mode, or an initial starting, the bypass line 122 prevents the coolant of low temperature from flowing into the first connecting line 114*a*. Therefore, it is prevented that the temperatures of the transmission oil and the engine oil are lowered through heat exchange with the coolant.

Figure 11:
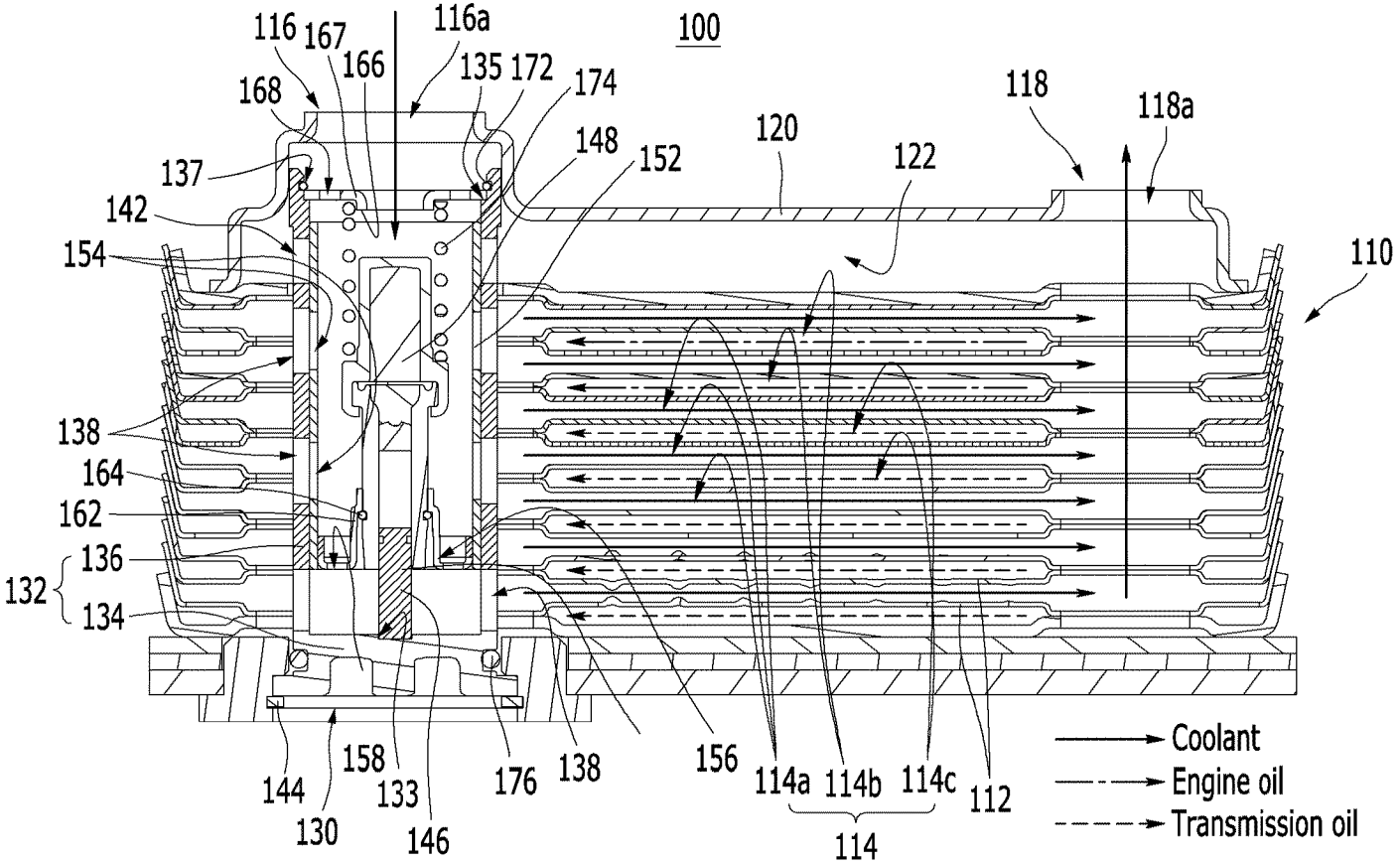

If the temperature of the coolant, on the contrary, is higher than the predetermined temperature, the deformable member 148 of the valve unit 130 moves upward on the fixing rod 146 as shown in FIG. 11 by the coolant flowing through the penetration hole 168 of the stopper 166.

In this case, the flange member 156 moves upward together with the deformable member 148, and the inner case 152 slides upward with the flange member 156 within the outer case 132.

Referring to FIG. 9, the bypass hole 142 are closed by the upper portion of the inner case 152, and the second openings 154 are positioned corresponding to the first openings 138.

Thus, the first and second openings 138 and 154 communicates the inside of the inner case 152 with the outside of the outer case 132, so the valve unit 130 is opened.

Then the coolant flowing into the valve unit 130, at a state that flowing into the bypass line 122 is prevented by closing the bypass hole though the inner case 152, flows out through the first and second openings 138 and 154, the first connecting line 114*a*, the heat radiating portion 110 and the first exhaust hole 118*a*.

A part of the coolant flowing into the first inflow hole 116*a*, not flowing into the valve unit 130, may flow through the bypass line 122 and flow out through the first exhaust hole 118*a* with the coolant flowing through the first connecting line 114*a*.

The coolant passing through the first connecting line 114*a* of the heat radiating portion 110 exchanges heat with the engine oil passing through the second inflow hole 116*b* and the second connecting line 114*b* and the transmission oil passing through the third inflow hole 116*c* and the third connecting line 114*c* within the heat radiating portion 110 so that the temperatures thereof may be controlled.

The coolant, the engine oil and the transmission oil flow different direction or opposition direction and exchange heat with each other because the first, second and third inflow holes 116*a*, 116*b* and 116*c* are formed to the upper portion or the lower portion of the heat radiating portion 110 in diagonal direction. Therefore, the transmission oil and the engine oil exchange heat with the coolant more efficiently.

Figure 12:
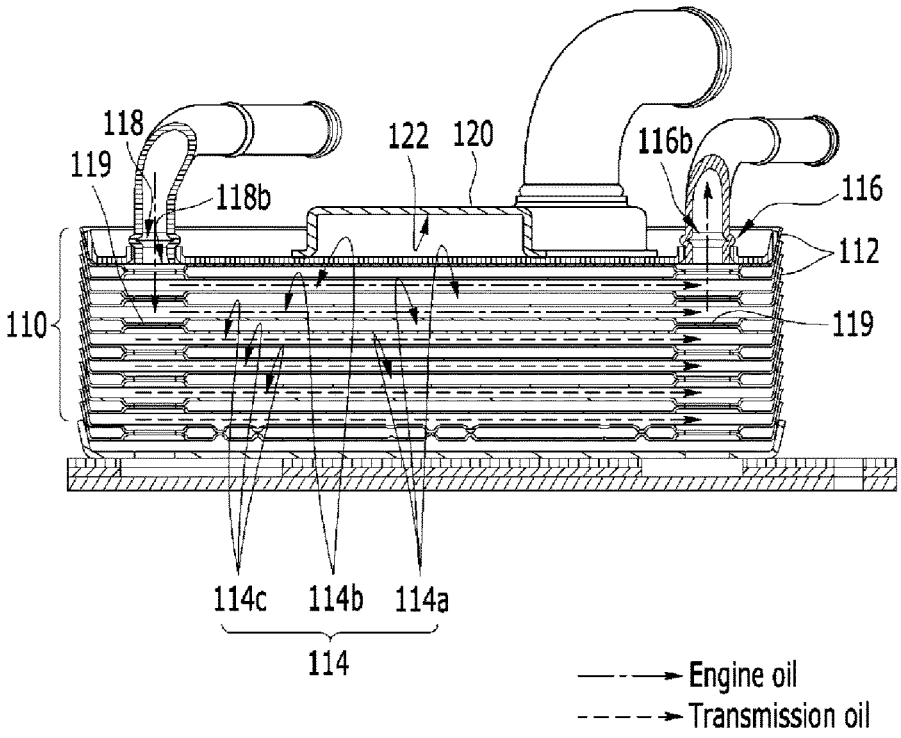

Meanwhile, as shown in FIG. 12, the engine oil flows from the engine 10 into the second inflow hole 116*b* formed to the upper portion of the heat radiating portion 110, passes the second connecting line 114*b*, and flows out through the second exhaust hole 118*b* so as to selectively exchange heat with the coolant by the operation of the valve unit 130.

Figure 13:
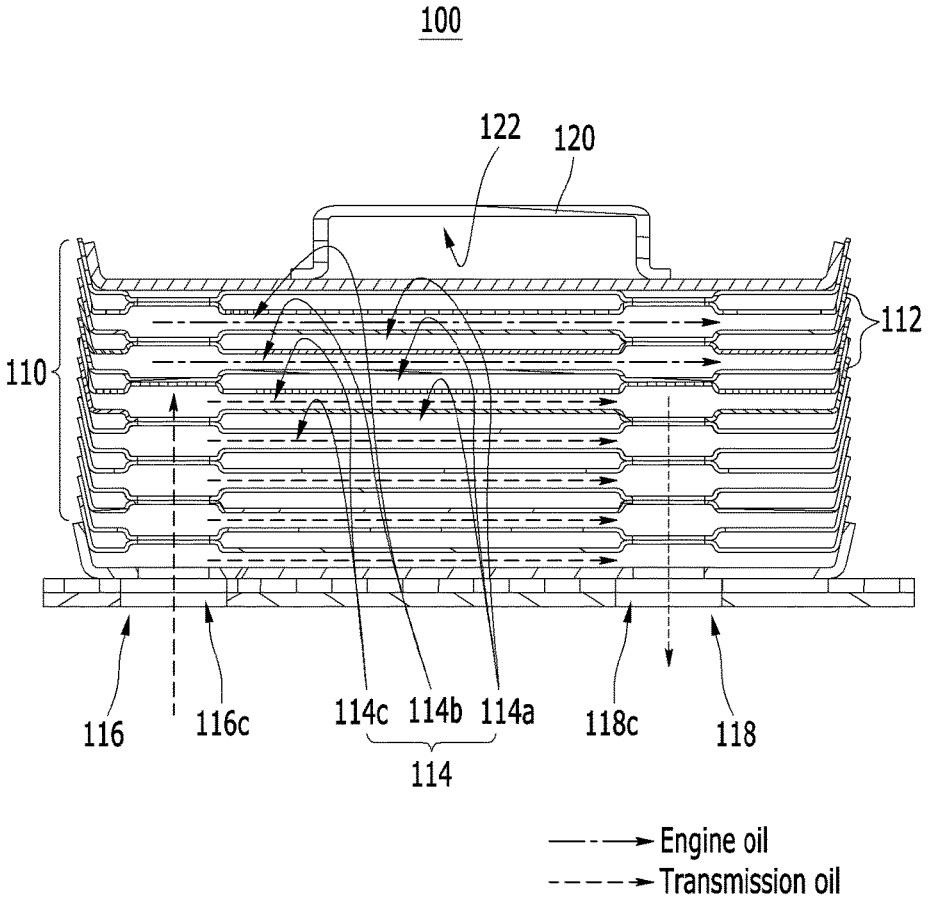

Meanwhile, as shown in FIG. 13, the transmission oil flows from the automatic transmission 40 into the third inflow hole 116*c* formed to the lower portion of the heat radiating portion 110, passes the third connecting line 114*c*, and flows out through the third exhaust hole 118*c* so as to selectively exchange heat with the coolant by the operation of the valve unit 130.

Therefore, the engine oil, the temperatures of which is raised by operation of the engine 10 and the transmission oil, the temperatures of which is raised by operation of a torque converter, are cooled through heat exchange with the coolant in the heat radiating portion 110 and is then supplied to the engine 10 and the automatic transmission 40 respectively.

That is, since the heat exchanger 100 supplies the cooled transmission oil to the automatic transmission 40 rotating with a high speed, occurrence of slip in the automatic transmission 40 is prevented as well as supplies the cooled engine oil to the engine 10 for pistons to be operated smoothly.

The deformable member 148 moves upward or downward on the fixing rod 146 according to the temperature of the coolant so as to adjust the position of the inner case 152 and simultaneously closes or opens each opening 138 and 154, thus the coolant flows through the bypass hole 142, or the first and second openings 138 and 154. Accordingly, the heat exchanger 100 according to various embodiments of the present invention may control flowing of the coolant passing through the heat exchanger 100.

If the heat exchanger 100 according to various embodiments of the present invention is applied, the operating fluids can be warmed up and cooled simultaneously by using the temperatures of the operating fluids at the running state or the initial starting condition of the vehicle. Therefore, the temperatures of the operating fluids can be controlled efficiently.

Also, the heat exchanger 100 may improve fuel economy and heating performance by controlling temperatures of the operating fluids according to condition of the vehicle, and of reducing assembling processes by simplifying a structure of the heat exchanger.

The valve unit 130 filled with the deformable material such as the wax material which may be expanded or contracted according to the flowed operating fluid may selectively supplies the coolant to the bifurcating portion 120 or the heat radiating portion 110. Therefore, constituent elements can be simplified and production cost may be curtailed. In addition, weight may be reduced.

Since additional bifurcation circuits are not needed, production cost may be curtailed, workability and utilization of space in a small engine compartment may be improved, and a layout of connecting hoses may be simplified.

If the operating fluid is the transmission oil in the automatic transmission 40, hydraulic friction at a cold starting may be lowered due to fast warm up. In addition, slip may be prevented and durability may be maintained at driving due to excellent cooling performance. Therefore, fuel economy and durability of the transmission may be improved.

It is exemplified in this specification that the coolant, the engine oil and the transmission oil are used as the operating fluids, but the operating fluids are not limited to these. All the operating fluids that require warming up or cooling can be used.

In addition, the heat exchanger according to various embodiments may further include covers and brackets that prevent damage of the heat exchanger and other components or that are used for fixing the heat exchanger to other components or the engine compartment.

For convenience in explanation and accurate definition in the appended claims, the terms upper or lower, rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A heat exchanger for a vehicle, comprising:

a heat radiating portion provided with a first connecting line, a second connecting line and a third connecting line formed alternately by a stacked plurality of plates, and receiving first, second and third operating fluids into the first, second and third connecting lines, respectively, the first, second and third operating fluids heat-exchanging with each other while passing through the first, second and third connecting lines, wherein the first, second and third operating fluids supplied into the first, second and third connecting lines are not mixed with each other while circulated;

a bifurcating portion configured to bypass one of the first, second and third operating fluids around the heat radiating portion according to a temperature of the one operating fluid;

a valve unit mounted at an inflow hole forming the bifurcating portion, selectively opening or closing one of the first second and third connecting lines by expansion or contraction of a deformable material filled therein to selectively direct the one operating fluid to the heat radiating portion or the bifurcating portion according to a temperature of the one operating fluid; and a plurality of inflow holes for the first, second and third operating fluids to flow into the heat radiating portion and the bifurcating portion; and a plurality of exhaust holes for the first, second and third operating fluid to flow out of the heat radiating portion and the bifurcating portion, wherein the plurality of inflow hole comprises:

a first inflow hole formed to the bifurcating portion;

a second inflow hole formed to one side of the heat radiating portion; and a third inflow hole formed to the other side of the heat radiating portion, and the plurality of exhaust hole comprises:

a first exhaust hole formed to the bifurcating portion and communicate with the first inflow hole through the first connecting line;

a second exhaust hole formed to the one side of the heat radiating portion and communicate with the second inflow hole through the second connecting line; and a third exhaust hole formed to the other side of the heat radiating portion communicate with the third inflow hole through the third connecting line, wherein the valve unit comprises:

an outer case including a fixing member which is inserted into the heat radiating portion corresponding to the first inflow hole, of which a mounting groove is formed lower center portion thereof, and fixed to the other side of the heat radiating portion, and an insert portion which is formed to an upper portion of the fixing member integrally, at which at least one first opening is formed along length direction thereof corresponding to the connecting line of the heat radiating portion, and at which at least one bypass hole is formed corresponding to the bifurcating portion;

a fixing rod which is inserted into the outer case and of which one end is fixed to the mounting groove of the fixing member;

a deformable member which is slidably disposed on the fixing rod, and moves up and down on the fixing rod by the expansion or contraction of the deformable material filled therein according to changing of temperature of the operating fluid;

an inner case of which at least one second opening is formed along length direction thereof corresponding to the first opening of the outer case, and which is slidably inserted into the outer case;

a flange member which is fixed to the lower portion of the inner case therein, and fixed to the lower portion of the deformable member;

a stopper fixedly mounted to the upper portion of the outer case; and an elastic member disposed between the deformable member and the stopper so as to supplying elastic force to the deformable member.

2. The heat exchanger of claim 1, wherein the fixing member of the outer case is fixed to the heat radiating portion though a snap ring.

3. The heat exchanger of claim 1, wherein the outer case is a cylinder of which the upper end is opened.

4. The heat exchanger of claim 1, wherein the bypass hole and the first opening are formed apart from each other along the length direction of the outer case.

5. The heat exchanger of claim 1, wherein the first openings are formed apart from the bypass hole at the lower portion of the outer case along the length direction of the outer case.

6. The heat exchanger of claim 1, wherein the inner case is a cylinder of which both ends are opened.

7. The heat exchanger of claim 1, wherein the second openings are formed apart from each other along the length direction of the inner case.

8. The heat exchanger of claim 7, wherein the second openings are formed misalign along the length direction of the inner case.

9. The heat exchanger of claim 1, wherein the inner case is moved upward when the deformable member moves upward so that the second opening is positioned at the first opening to open the first opening and close the bypass hole by the inner case.

10. The heat exchanger of claim 1, wherein the inner case is assembled at the first time as the first opening is closed by the inner case and the second opening is closed by the outer case.

11. The heat exchanger of claim 1, wherein the deformable material filled within the deformable member is wax material which is expanded or contracted according to the temperature of the operating fluid flowing into the inflow hole.

12. The heat exchanger of claim 1, wherein flowing holes are formed to the exterior circumference of the flange member.

13. The heat exchanger of claim 1, wherein the exterior circumference of the flange member is fixed to the lower interior circumference of the inner case, and a mounting portion formed to the center portion of the flange member is connected to the deformable member and the flange member is fixed by a fixing ring mounted to the deformable member.

14. The heat exchanger of claim 1, wherein the flange member is connected to the interior circumference of the inner case.

15. The heat exchanger of claim 1, wherein at least one penetration hole is formed to the stopper for the operating fluid flowing through the first inflow hole to flow within the valve unit.

16. The heat exchanger of claim 15, wherein the penetration holes are formed to the center and along circumference of the stopper.

17. The heat exchanger of claim 1, wherein a fixing end is formed protrude to the stopper for the elastic member to be fixed under the stopper.

18. The heat exchanger of claim 1, wherein a receiving portion, where the stopper is received, is formed to the upper portion of the outer case.

19. The heat exchanger of claim 18, wherein a ring groove is formed to the upper and interior circumference of the outer case for a stopper ring to be received thereto for fixing the upper portion of the stopper.

20. The heat exchanger of claim 1, wherein the first inflow hole and the first exhaust hole are formed to the bifurcating portion in diagonal direction, the second inflow hole and the second exhaust hole are formed in the one side of the heat radiating portion facing diagonally with each other, wherein the second inflow hole is disposed symmetrical to the first inflow hole and the second exhaust hole is disposed symmetrical to the first exhaust hole, and the third inflow hole and the third exhaust hole are formed the other side of the heat radiating portion facing diagonally with each other.

21. The heat exchanger of claim 1, wherein one of operating fluids is a coolant flowing from a radiator, another operating fluid is a transmission oil flowing from an automatic transmission, and the other operating fluid is an engine oil from an engine.

22. The heat exchanger of claim 21, wherein the heat radiating portion is mounted to the automatic transmission, the coolant flows through the first inflow hole and first exhaust hole, the engine oil flows through the second inflow hole and second exhaust hole, and the transmission oil flows through the third inflow hole and the third exhaust hole.

23. The heat exchanger of claim 22, wherein the heat radiating portion causes the operating fluid to exchange heat with each other by counterflow of the operating fluids.

* * * * *